US010961690B2

(12) United States Patent
Chiba et al.

(10) Patent No.: US 10,961,690 B2
(45) Date of Patent: Mar. 30, 2021

(54) WORK MACHINE

(71) Applicant: HITACHI CONSTRUCTION MACHINERY CO., LTD., Tokyo (JP)

(72) Inventors: Takaaki Chiba, Kasumigaura (JP); Hiroyuki Yamada, Hitachinaka (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 220 days.

(21) Appl. No.: 16/328,879

(22) PCT Filed: Sep. 13, 2017

(86) PCT No.: PCT/JP2017/033160
§ 371 (c)(1),
(2) Date: Feb. 27, 2019

(87) PCT Pub. No.: WO2019/053833
PCT Pub. Date: Mar. 21, 2019

(65) Prior Publication Data

US 2020/0232188 A1 Jul. 23, 2020

(51) Int. Cl.
*E02F 9/22* (2006.01)
*E02F 3/43* (2006.01)
(Continued)

(52) U.S. Cl.
CPC ..... *E02F 9/2285* (2013.01); *E02F 9/2033* (2013.01); *E02F 9/2296* (2013.01);
(Continued)

(58) Field of Classification Search
None
See application file for complete search history.

(56) References Cited

U.S. PATENT DOCUMENTS 5,666,807 A 9/1997 Bianchetta
5,887,365 A * 3/1999 Fujishima ..... E02F 3/437 37/348
(Continued)

FOREIGN PATENT DOCUMENTS

JP 09-177723 A 7/1997
JP 10-008491 A 1/1998
JP 10-274211 A 10/1998

OTHER PUBLICATIONS

International Search Report of PCT/JP2017/033160 dated Dec. 19, 2017.
(Continued)

*Primary Examiner* — Nathaniel E Wiehe
*Assistant Examiner* — Michael Quandt
(74) *Attorney, Agent, or Firm* — Mattingly & Malur, PC

(57) ABSTRACT

A work machine is provided. The work machine includes a changeover valve capable of disabling area limiting control by bypassing an area limiting control solenoid proportional valve disposed in a pilot line through which pilot pressure generated by a hydraulic pilot type operation device is guided to a directional control valve and the work machine can perform the area limiting control while ensuring response of a work implement. When a first fluid temperature T1 is higher than a first predetermined temperature Ta and a control changeover switch 66 specifies disabling of the area limiting control, a controller brings a plurality of changeover valves into a bypass position. When the first fluid temperature T1 is equal to or lower than the first predetermined temperature Ta, the controller brings the changeover valves into a communication position and places the solenoid proportional valves in a fully open position.

6 Claims, 13 Drawing Sheets

| | T2 ≤ Tc | T1 ≤ Ta<br>T2 > Tc | Ta < T1 ≤ Tb<br>T2 > Tc | T1 > Tb<br>T2 > Tc |
|---|---|---|---|---|
| CONTROL CHANGEOVER SWITCH ON | CHANGEOVER VALVE OFF<br>CONTROL DISABLED<br>WARM-UP INSTRUCTION A DISPLAY | CHANGEOVER VALVE ON<br>CONTROL DISABLED<br>WARM-UP INSTRUCTION A DISPLAY | CHANGEOVER VALVE ON<br>CONTROL ENABLED<br>WARM-UP INSTRUCTION B DISPLAY | CHANGEOVER VALVE ON<br>CONTROL ENABLED<br>WARM-UP INSTRUCTION NON-DISPLAY |
| CONTROL CHANGEOVER SWITCH OFF | CHANGEOVER VALVE OFF<br>CONTROL DISABLED<br>WARM-UP INSTRUCTION A DISPLAY | CHANGEOVER VALVE ON<br>CONTROL DISABLED<br>WARM-UP INSTRUCTION A DISPLAY | CHANGEOVER VALVE OFF<br>CONTROL DISABLED<br>WARM-UP INSTRUCTION NON-DISPLAY | CHANGEOVER VALVE OFF<br>CONTROL DISABLED<br>WARM-UP INSTRUCTION NON-DISPLAY |

(51) Int. Cl.
*F15B 21/0427* (2019.01)
*E02F 9/20* (2006.01)

(52) U.S. Cl.
CPC ..... *E02F 3/435* (2013.01); *E02F 9/2221* (2013.01); *E02F 9/2267* (2013.01); *E02F 9/2282* (2013.01); *F15B 21/0427* (2019.01); *F15B 2211/20576* (2013.01); *F15B 2211/62* (2013.01); *F15B 2211/6316* (2013.01); *F15B 2211/6343* (2013.01); *F15B 2211/6346* (2013.01); *F15B 2211/6355* (2013.01); *F15B 2211/66* (2013.01); *F15B 2211/67* (2013.01)

(56) References Cited

U.S. PATENT DOCUMENTS 6,098,322 A * 8/2000 Tozawa ..... E02F 3/437 37/414
10,760,245 B2 * 9/2020 Morita ..... E02F 3/435

OTHER PUBLICATIONS

International Preliminary Report on Patentability received in corresponding International Application No. PCT/JP2017/033160 dated Mar. 26, 2020.

* cited by examiner

FIG. 12

| | $T2 \leq Tc$ | $T1 \leq Ta$<br>$T2 > Tc$ | $Ta < T1 \leq Tb$<br>$T2 > Tc$ | $T1 > Tb$<br>$T2 > Tc$ |
|---|---|---|---|---|
| CONTROL CHANGEOVER SWITCH ON | CHANGEOVER VALVE OFF<br>CONTROL DISABLED<br>WARM-UP INSTRUCTION A DISPLAY | CHANGEOVER VALVE ON<br>CONTROL DISABLED<br>WARM-UP INSTRUCTION A DISPLAY | CHANGEOVER VALVE ON<br>CONTROL ENABLED<br>WARM-UP INSTRUCTION B DISPLAY | CHANGEOVER VALVE ON<br>CONTROL ENABLED<br>WARM-UP INSTRUCTION NON-DISPLAY |
| CONTROL CHANGEOVER SWITCH OFF | CHANGEOVER VALVE OFF<br>CONTROL DISABLED<br>WARM-UP INSTRUCTION A DISPLAY | CHANGEOVER VALVE ON<br>CONTROL DISABLED<br>WARM-UP INSTRUCTION A DISPLAY | CHANGEOVER VALVE OFF<br>CONTROL DISABLED<br>WARM-UP INSTRUCTION NON-DISPLAY | CHANGEOVER VALVE OFF<br>CONTROL DISABLED<br>WARM-UP INSTRUCTION NON-DISPLAY |

WORK MACHINE

TECHNICAL FIELD

The present invention relates to a work machine such as a hydraulic excavator.

BACKGROUND ART

A work machine, such as a hydraulic excavator, typically includes a work implement that is driven by a hydraulic actuator. The hydraulic actuator is driven by hydraulic fluid supplied from a hydraulic pump. The hydraulic fluid supplied from the hydraulic pump to the hydraulic actuator is controlled by a directional control valve. The directional control valve is operated by pilot pressure generated by a hydraulic pilot type operation device. The hydraulic pilot type operation device generates pilot pressure that corresponds to a lever operation performed by an operator.

In the work machine that uses hydraulic pressure as drive power, the work implement tends to reduce response thereof due to increased viscosity of the hydraulic fluid when temperature of the hydraulic fluid decreases. As one solution, Patent Document 1, for example, discloses a front controller for a construction machine. This front controller enables front control to be performed accurately and safely even when the temperature of the hydraulic fluid is low.

The front controller for a construction machine disclosed in Patent Document 1 is intended for use in a construction machine that includes a multi-articulated front implement, a plurality of hydraulic actuators, and a plurality of hydraulic control valves. The multi-articulated front implement includes a plurality of front members rotatable in a vertical direction. The hydraulic actuators drive the front members. The hydraulic control valves are driven by signals from a plurality of operation devices and vary flow rates of the hydraulic fluid to be supplied to the hydraulic actuators. The front controller controls the front implement so as to move within a predetermined area. The front controller includes a fluid temperature detection device and a warning device. The fluid temperature detection device detects temperature of the hydraulic fluid. The warning device determines in which one of at least three fluid temperature ranges including a first fluid temperature range, a second fluid temperature range higher than the first fluid temperature range, and a third fluid temperature range higher than the second fluid temperature range, the temperature of the hydraulic fluid detected by the fluid temperature detection device falls, and issues a warning in a manner different between the first fluid temperature range and the second fluid temperature range when the temperature of the hydraulic fluid falls in the first and second fluid temperature ranges (claim 1).

The construction machine disclosed in Patent Document 1 allows the operator to determine whether the fluid temperature that constitutes an important factor in operating the construction machine is low and how low the fluid temperature is during performance of work. Specifically, because response is expected to be low when the fluid temperature falls in the second fluid temperature range (relatively low), the operator tends to be conscious of careful operation of the construction machine, so that front control can be improved. The fluid temperature falling in the first fluid temperature range (considerably low) is not suitable for the front control, so that the operator performs work through use of the ordinary operation devices without using the front control.

Thus, the front control can be accurately and safely performed even when the temperature of the hydraulic fluid is low.

PRIOR ART DOCUMENT

Patent Document

Patent Document 1: JP-1998-8491-A

SUMMARY OF THE INVENTION

Problems to be Solved by the Invention

With a work machine such as a hydraulic excavator, area limiting control is known for controlling operation of the work implement such that the work implement does not enter a predetermined area. The area limiting control is performed by reducing or boosting pilot pressure output from a hydraulic pilot type operation device using a solenoid proportional valve.

Pressure loss and leakage flow occur in the solenoid proportional valve used in the area limiting control. Thus, response of the work implement tends to be reduced when the pilot pressure is guided to the directional control valve via the solenoid proportional valve, compared with a case in which the pilot pressure is guided not by way of the solenoid proportional valve. Thus, for work requiring high accuracy, such as shaping work, preferably the directional control valve is operated by a pilot pressure that has been reduced or boosted by the solenoid proportional valve. For work requiring high response, such as shaking work, preferably the directional control valve is operated directly by a pilot pressure that has been generated in response to a lever operation. Thus, a changeover valve is disposed in the pilot line that guides the pilot pressure output from the operation device to the directional control valve. The changeover valve bypasses the solenoid proportional valve to thereby disable the area limiting control.

The application of the front implement disclosed in Patent Document 1 to the work machine having such area limiting control poses the following problem.

Bypassing the solenoid proportional valve interrupts communication of the hydraulic fluid through, out of the pilot line, a line portion connecting the changeover valve with the solenoid proportional valve. Thus, when work is continuously performed under a condition in which the solenoid proportional valve is bypassed (the area limiting control is disabled), the temperature of the hydraulic fluid stagnant in the line portion tends to be reduced, while the temperature of the hydraulic fluid flowing through portions other than the line portion is maintained at a high level. The front implement disclosed in Patent Document 1, because being configured so as to detect only the temperature of the hydraulic fluid flowing via a hydraulic pump, is unable to issue warning to the operator even when the temperature of the hydraulic fluid stagnant in the line portion connecting the changeover valve with the solenoid proportional valve is low. If the operator cancels the bypassing of the solenoid proportional valve to thereby start work using the area limiting control under the condition in which the temperature of the hydraulic fluid stagnant in the line portion connecting the changeover valve with the solenoid proportional valve is low, the response of the work implement is reduced and the work implement may enter the predetermined area.

The present invention has been made to solve the foregoing problem and an object of the present invention is to provide a work machine that includes a changeover valve capable of disabling area limiting control by bypassing an area limiting control solenoid proportional valve disposed in a pilot line through which pilot pressure generated by a hydraulic pilot type operation device is guided to a directional control valve, and that can perform the area limiting control while ensuring response of a work implement.

Means for Solving the Problems

To achieve the foregoing object, an aspect of the present invention provides a work machine that includes: a prime mover; a hydraulic pump driven by the prime mover; a pilot pump driven by the prime mover; a plurality of hydraulic actuators driven by hydraulic fluid supplied from the hydraulic pump; a work implement driven by the hydraulic actuators; a plurality of directional control valves that control the hydraulic fluid supplied from the hydraulic pump to the hydraulic actuators; a plurality of hydraulic pilot type operation devices that reduce pressure of the hydraulic fluid supplied from the pilot pump to thereby generate a plurality of pilot pressures for operating the directional control valves; a plurality of solenoid proportional valves disposed in a plurality of pilot lines through which the pilot pressures are guided to the directional control valves, the solenoid proportional valves being operable between a fully open position at which the pilot pressures are not reduced and a fully closed position at which the pilot pressures are interrupted; a controller that performs area limiting control for correcting the pilot pressures by operating the solenoid proportional valves so as not to allow the work implement to enter a predetermined area; a control changeover switch that specifies enabling or disabling of the area limiting control; and a plurality of changeover valves disposed in the pilot lines, the changeover valves being capable of being brought into a communication position at which communication is provided through the pilot lines or a bypass position at which the solenoid proportional valves are bypassed. This work machine further includes: a first fluid temperature detection device that detects as a first fluid temperature a temperature of the hydraulic fluid flowing through, out of the pilot lines, lines between the changeover valves and the solenoid proportional valves. In this work machine, the controller includes: a state determination section that determines whether the first fluid temperature is higher than a first predetermined temperature and determines which, whether enabling or disabling, the control changeover switch specifies for the area limiting control; a changeover valve control section that brings the changeover valves into the communication position when the state determination section determines that the first fluid temperature is higher than the first predetermined temperature and determines that the control changeover switch specifies enabling for the area limiting control, that brings the changeover valves into the bypass position when the state determination section determines that the first fluid temperature is higher than the first predetermined temperature and determines that the control changeover switch specifies disabling for the area limiting control, and that brings the changeover valves into the communication position when the state determination section determines that the first fluid temperature is equal to or lower than the first predetermined temperature; and a solenoid proportional valve control section that operates the solenoid proportional valves in accordance with the area limiting control when the state determination section determines that the first fluid temperature is higher than the first predetermined temperature and determines that the control changeover switch specifies enabling of the area limiting control, and that brings the solenoid proportional valves into the fully open position when the state determination section determines that the first fluid temperature is equal to or lower than the first predetermined temperature.

With the aspect of the present invention, when the first fluid temperature is higher than the first predetermined temperature and the control changeover switch specifies enabling of the area limiting control, the changeover valves are brought into the communication position and the solenoid proportional valves are operated according to the area limiting control. Thereby, the area limiting control can be performed while response of the work implement is achieved.

When the first fluid temperature is higher than the first predetermined temperature and the control changeover switch specifies disabling of the area limiting control, the changeover valves are brought into the bypass position, so that the hydraulic fluid does not flow through, out of the pilot lines, the lines that connect between the changeover valves and the solenoid proportional valves. Response of the work implement can thereby be improved.

When the first fluid temperature is equal to or lower than the first predetermined temperature, the changeover valves are brought into the communication position and the solenoid proportional valves are placed in the fully open position to thereby allow the hydraulic fluid to flow through, out of the pilot lines, the lines that connect between the changeover valves and the solenoid proportional valves. The fluid temperature at the lines can thereby be maintained at a temperature higher than the first predetermined temperature (at which the response of the work implement can be achieved) even while the area limiting control is disabled.

Advantages of the Invention

In accordance with the present invention, in the work machine that can disable the area limiting control by bypassing, with the changeover valve, the solenoid proportional valve for the area limiting control disposed in the pilot line through which the pilot pressure output from the hydraulic pilot type operation device is guided to the directional control valve, the area limiting control can be performed while response of the work implement is achieved.

BRIEF DESCRIPTION OF THE DRAWINGS

FIG. 12 is a diagram depicting correspondence between a first temperature, a second temperature, and a position of a control changeover switch, and a command output from a state determination section to a display device, a changeover valve control section, and a solenoid proportional valve control section.

MODES FOR CARRYING OUT THE INVENTION

Figure 1:
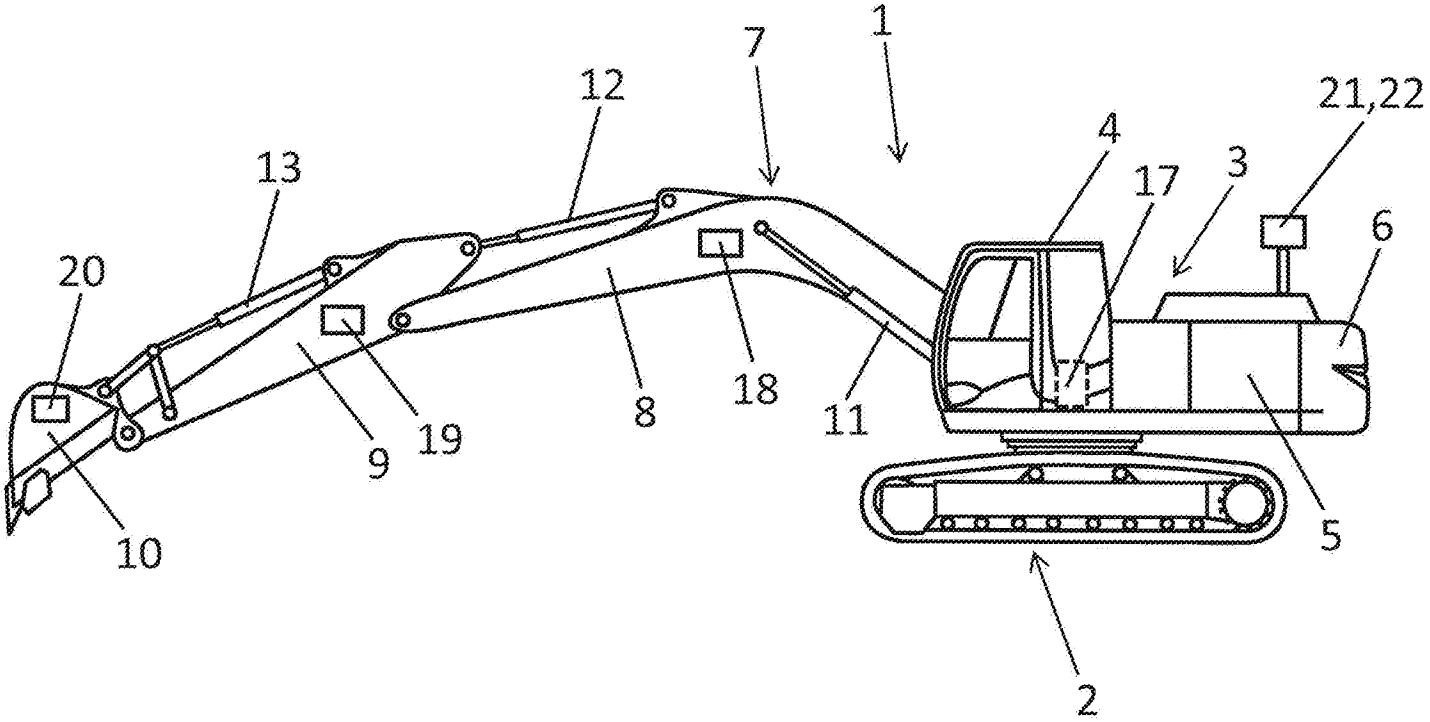
FIG. 1 is a side elevation view of a hydraulic excavator according to an embodiment of the present invention.

A hydraulic excavator that exemplifies a work machine according to an embodiment of the present invention will be described below with reference to the accompanying drawings. Like or corresponding members are identified by the same reference numerals in the drawings and descriptions, once given, will not be repeated as appropriate.

FIG. 1 is a side elevation view of a hydraulic excavator according to an embodiment of the present invention. As depicted in FIG. 1, this hydraulic excavator 1 includes a track structure 2 and a swing structure 3. The track structure 2 travels by driving crawlers disposed on left and right side portions. The swing structure 3 is disposed swingably on the track structure 2.

The swing structure 3 includes a cab 4, a machine chamber 5, and a counterweight 6. The cab 4 is disposed on the left side at a front portion of the swing structure 3. The machine chamber 5 is disposed posterior to the cab 4. The counterweight 6 is disposed posterior to the machine chamber 5, specifically, at a rear end of the swing structure 3.

The swing structure 3 includes a work implement 7. The work implement 7 is disposed at a center at a front portion of the swing structure 3 on the right side of the cab 4. The work implement 7 includes a boom 8, an arm 9, a bucket 10, a boom cylinder 11, an arm cylinder 12, and a bucket cylinder 13. The boom 8 has a proximal end portion mounted rotatably at a front portion of the swing structure via a boom pin. The arm 9 has a proximal end portion mounted rotatably at a distal end portion of the boom 8 via an arm pin. The bucket 10 has a proximal end portion mounted rotatably at a distal end portion of the arm 9 via a bucket pin. The boom cylinder 11, the arm cylinder 12, and the bucket cylinder 13 are each a hydraulic cylinder driven by hydraulic fluid. The boom cylinder 11 drives the boom 8. The arm cylinder 12 drives the arm 9. The bucket cylinder 13 drives the bucket 10.

A hydraulic pump 14, a pilot pump 15, an engine 16 as a prime mover (depicted in FIG. 3), and other parts are disposed inside the machine chamber 5.

A vehicle body inclination sensor 17 is mounted inside the cab 4. A boom inclination sensor 18 is mounted on the boom 8. An arm inclination sensor 19 is mounted on the arm 9. A bucket inclination sensor 20 is mounted on the bucket 10. The vehicle body inclination sensor 17, the boom inclination sensor 18, the arm inclination sensor 19, and the bucket inclination sensor 20 are each, for example, an inertial measurement unit (IMU). The vehicle body inclination sensor 17 measures a vehicle body-to-ground angle. The boom inclination sensor 18 measures a boom-to-ground angle. The arm inclination sensor 19 measures an arm-to-ground angle. The bucket inclination sensor 20 measures a bucket-to-ground angle. A first GNSS antenna 21 and a second GNSS antenna 22 are mounted on the left and right sides at a posterior portion of the swing structure 3. Position information acquired from the first GNSS antenna 21 and the second GNSS antenna 22 enables a global coordinate of a vehicle body reference position P0 (depicted in FIG. 2) to be calculated.

Figure 2:
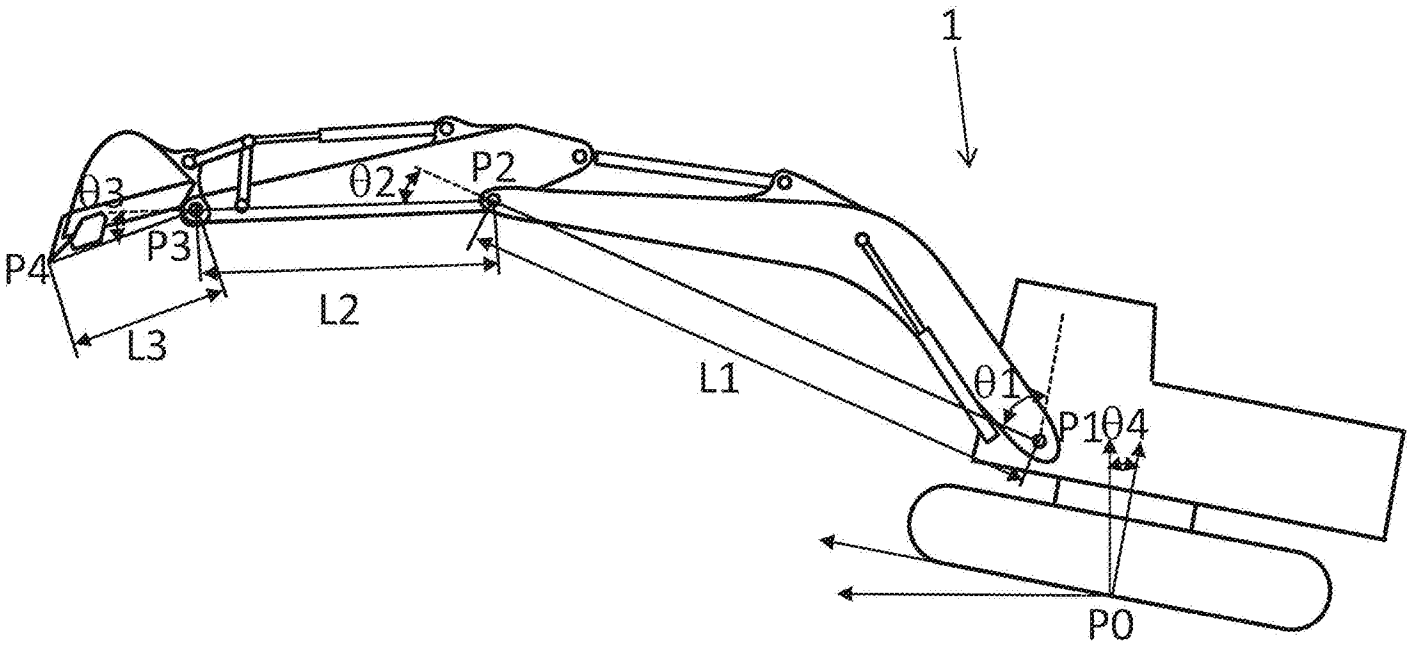
FIG. 2 is a schematic diagram of a configuration of the hydraulic excavator.

FIG. 2 is a schematic diagram of a configuration of the hydraulic excavator 1. As depicted in FIG. 2, a length of the boom 8, specifically, a length between a boom pin position P1 and an arm pin position P2 is L1. A length of the arm 9, specifically, a length between the arm pin position P2 and a bucket pin position P3 is L2. A length of the bucket 10, specifically, a length between the bucket pin position P3 and a bucket claw tip position P4 is L3. Additionally, vehicle body inclination relative to the global coordinate system, specifically, an angle of a vehicle body perpendicular direction relative to a vertical direction perpendicular to a horizontal plane (hereinafter referred to as a vehicle body inclination angle) is θ4. An angle formed between a line segment connecting the boom pin position P1 with the arm pin position P2 and the vehicle body perpendicular direction is θ1, which is hereinafter referred to as a boom angle θ1. An angle formed between a line segment connecting the arm pin position P2 with the bucket pin position P3 and a straight line composed of the boom pin position P1 and the arm pin position P2 (hereinafter referred to as an arm angle) is θ2. An angle formed between a line segment connecting the bucket pin position P3 with the bucket claw tip position P4 and a straight line composed of the arm pin position P2 and the bucket pin position P3 (hereinafter referred to as a bucket angle) is θ3.

Figure 3:
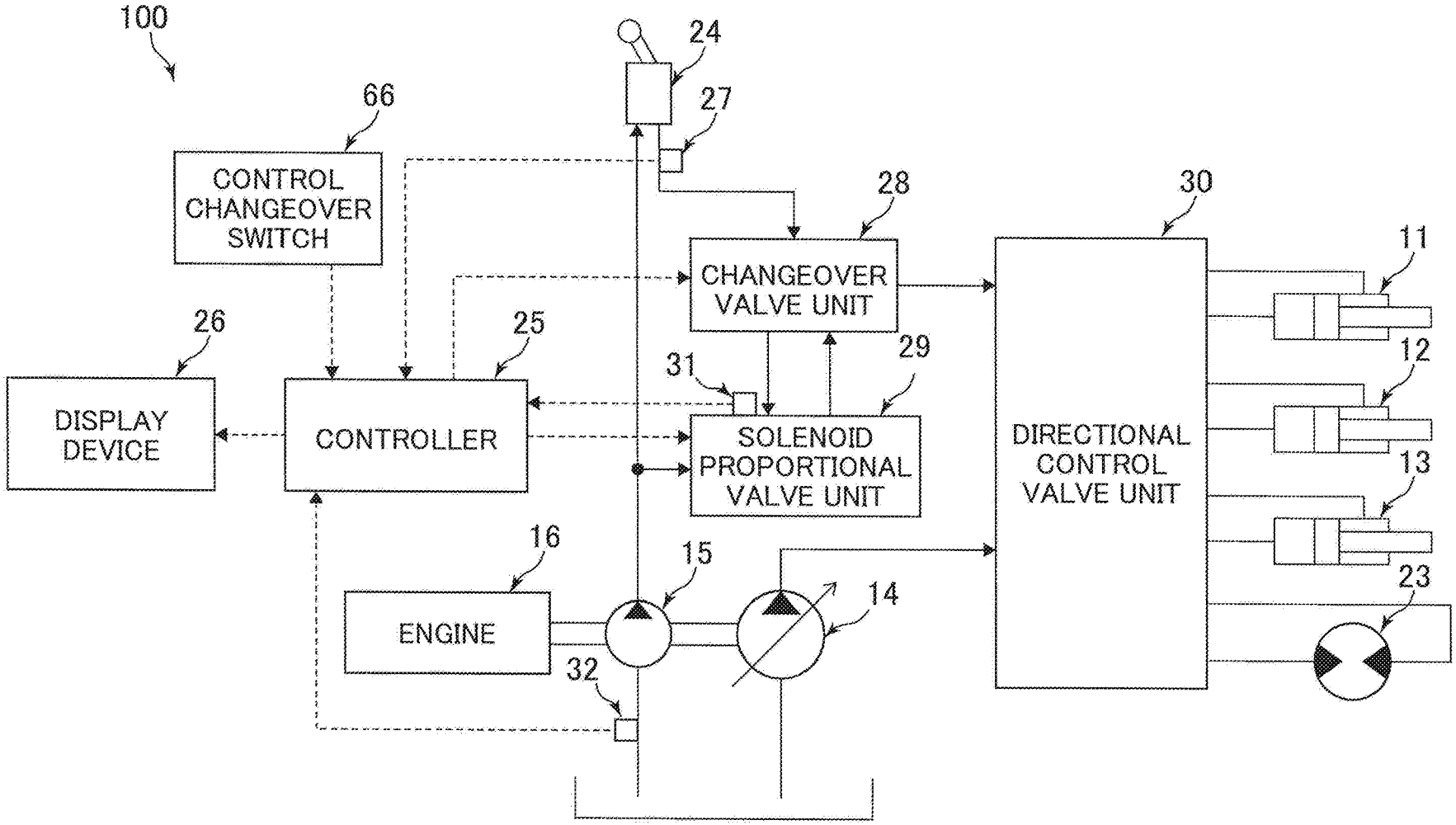
FIG. 3 is a configuration diagram of a hydraulic control system mounted in the hydraulic excavator.

FIG. 3 is a configuration diagram of a hydraulic control system mounted in the hydraulic excavator 1. As depicted in FIG. 3, a hydraulic control system 100 includes the engine 16, the hydraulic pump 14, the pilot pump 15, an operation lever device 24, a directional control valve unit 30, a controller 25, a solenoid proportional valve unit 29, a changeover valve unit 28, a display device 26, a pilot pressure sensor 27, a first temperature sensor 31, a temperature sensor 32, and a control changeover switch 66. The hydraulic pump 14 and the pilot pump 15 are driven by the engine 16. The operation lever device 24 serves as a hydraulic pilot type operation device that reduces pressure of hydraulic fluid supplied from the pilot pump 15 (primary pilot pressure) to in response to a lever operation amount and outputs the pilot pressure. The directional control valve unit 30 is driven by the pilot pressure output from the operation lever device 24 and controls the hydraulic fluid supplied from the hydraulic pump 14 to the boom cylinder 11, the arm cylinder 12, the bucket cylinder 13, and a swing motor 23. The controller 25 serves as a controller. The solenoid proportional valve unit 29 reduces or boosts the pilot pressure output from the operation lever device 24 so as to correspond to the output from the controller 25 and outputs the resultant pilot pressure. The changeover valve unit 28 switches a path through which the hydraulic fluid (pilot pressure) output from the operation lever device 24 is guided to the directional control valve unit 30 between one by way of the solenoid proportional valve unit 29 and one directly to the directional control valve unit 30. The display device 26 is disposed in the cab 4 (depicted in FIG. 1). The pilot pressure sensor 27 detects the lever operation amount of the operation lever device 24 (pilot pressure). The first temperature sensor 31 serves as a first fluid temperature detection device that detects a temperature (first temperature) of the hydraulic fluid passing through the solenoid proportional valve unit 29. The temperature sensor 32 serves as a second fluid temperature detection device that detects a temperature (second temperature) of the hydraulic fluid drawn in the pilot pump 15. The control changeover switch 66 specifies enabling or disabling of area limiting control.

Figure 4:
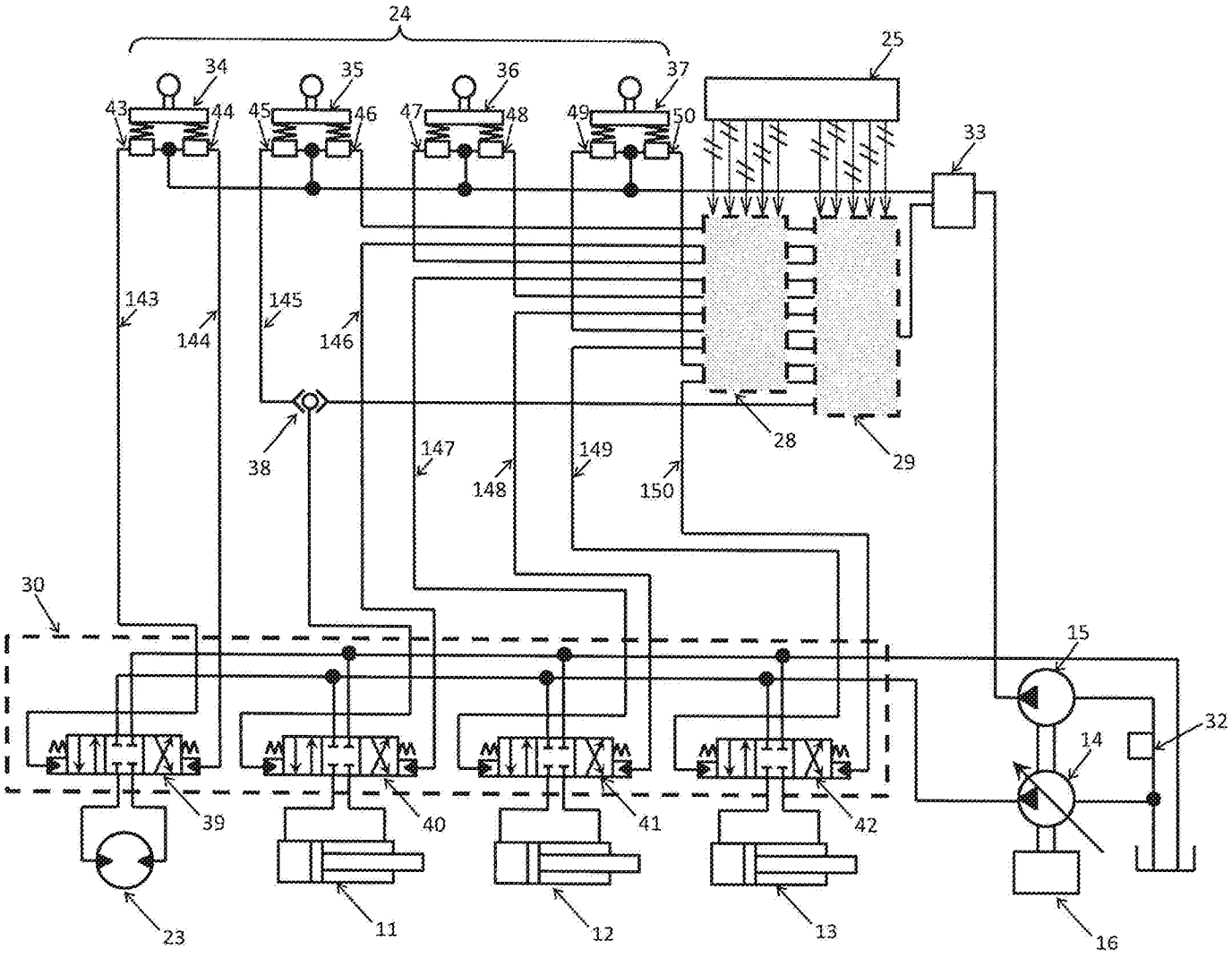
FIG. 4 is a hydraulic circuit diagram of the hydraulic control system.

FIG. 4 is a hydraulic circuit diagram of the hydraulic control system 100. As depicted in FIG. 4, the operation lever device 24 includes a swing operation lever 34, a boom operation lever 35, an arm operation lever 36, and a bucket operation lever 37. The operation lever device 24 further includes a clockwise swing pilot control valve 43 and a counterclockwise swing pilot control valve 44 that are driven by the swing operation lever 34. The operation lever device 24 further includes a boom raise pilot control valve 45 and a boom lower pilot control valve 46 that are driven by the boom operation lever 35. The operation lever device 24 further includes an arm pull pilot control valve 47 and an arm push pilot control valve 48 that are driven by the arm operation lever 36. The operation lever device 24 further includes a bucket crowd pilot control valve 49 and a bucket dump pilot control valve 50 that are driven by the bucket operation lever 37. The directional control valve unit 30 includes a swing directional control valve 39, a boom directional control valve 40, an arm directional control valve 41, and a bucket directional control valve 42. The swing directional control valve 39 controls hydraulic fluid supplied from the hydraulic pump 14 to the swing motor 23. The boom directional control valve 40 controls hydraulic fluid supplied from the hydraulic pump 14 to the boom cylinder 11. The arm directional control valve 41 controls hydraulic fluid supplied from the hydraulic pump 14 to the arm cylinder 12. The bucket directional control valve 42 controls hydraulic fluid supplied from the hydraulic pump 14 to the bucket cylinder 13.

A pilot shutoff valve 33 shuts off the hydraulic fluid supplied from the pilot pump 15 to the operation lever device (primary pilot pressure) to thereby prevent the hydraulic actuators 11 to 12 and 23 from operating when the operation levers 34 to 37 are not operated.

The swing operation lever 34 drives the clockwise swing pilot control valve 43 or the counterclockwise swing pilot control valve 44 to thereby supply the pilot pressure to the swing directional control valve 39 via a clockwise swing pilot line 143 or a counterclockwise swing pilot line 144, thereby driving the swing motor 23. The boom operation lever 35 drives the boom raise pilot control valve 45 or the boom lower pilot control valve 46 to thereby supply the pilot pressure to the boom directional control valve 40 via a boom raise pilot line 145 or a boom lower pilot line 146, thereby driving the boom cylinder 11. The arm operation lever 36 drives the arm pull pilot control valve 47 or the arm push pilot control valve 48 to thereby supply the pilot pressure to the arm directional control valve 41 via an arm pull pilot line 147 or an arm push pilot line 148, thereby driving the arm cylinder 12. The bucket operation lever 37 drives the bucket crowd pilot control valve 49 or the bucket dump pilot control valve 50 to thereby supply the pilot pressure to the bucket directional control valve 42 via a bucket crowd pilot line 149 or a bucket dump pilot line 150, thereby driving the bucket cylinder 13.

The pilot pressure output from the boom raise pilot control valve 45 is guided to the boom directional control valve 40 via a boom raise operation shuttle valve 38. The boom raise operation shuttle valve 38 guides the boom raise pilot pressure output from the boom raise pilot control valve 45 or the boom raise pilot pressure output from the solenoid proportional valve unit 29, whichever is greater, to the boom directional control valve 40. Additionally, the pilot pressures output from the boom lower pilot control valve 46, the arm pull pilot control valve 47, the arm push pilot control valve 48, the bucket crowd pilot control valve 49, and the bucket dump pilot control valve 50 are guided to the directional control valves 40 to 42 via the changeover valve unit 28.

Figure 5:
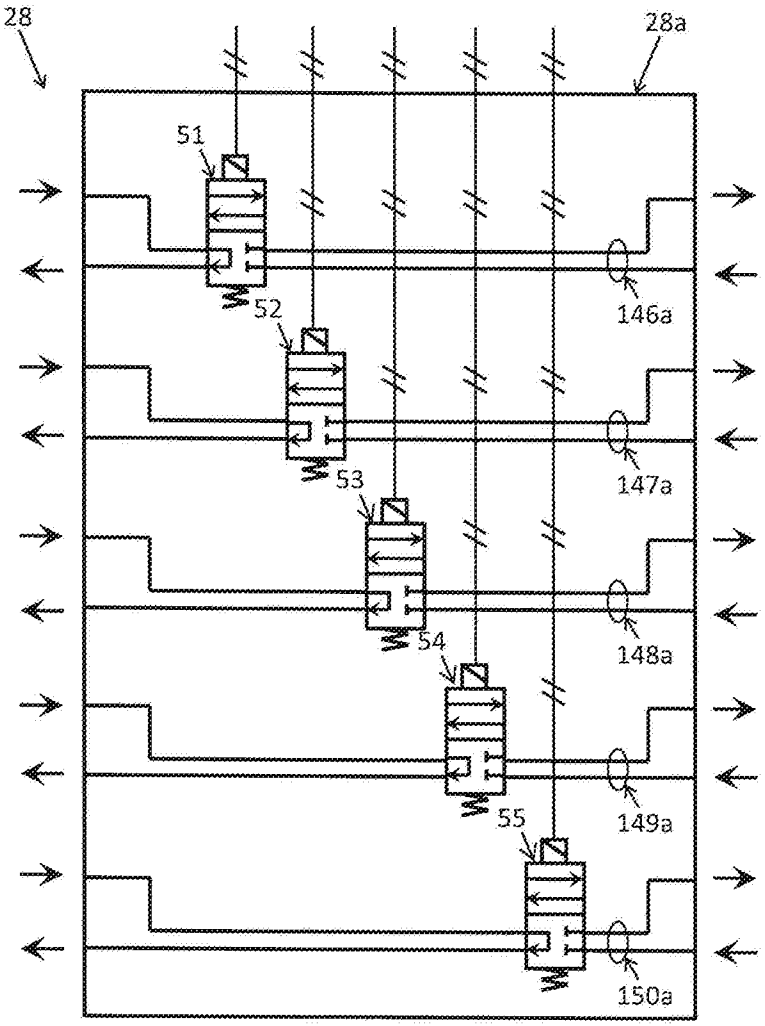
FIG. 5 is a hydraulic circuit diagram of a changeover valve unit.

FIG. 5 is a hydraulic circuit diagram of the changeover valve unit 28. As depicted in FIG. 5, the changeover valve unit 28 includes changeover valves 51 to 55 and a housing 28*a*, which houses the changeover valves 51 to 55.

A boom lower pilot changeover valve 51 selects whether to guide the pilot pressure output from the boom lower pilot control valve 46 to the boom directional control valve 40 or to the solenoid proportional valve unit 29. An arm pull pilot changeover valve 52 selects whether to guide the pilot pressure output from the arm pull pilot control valve 47 to the arm directional control valve 41 or to the solenoid proportional valve unit 29. An arm push pilot changeover valve 53 selects whether to guide the pilot pressure output from the arm push pilot control valve 48 to the arm directional control valve 41 or to the solenoid proportional valve unit 29. A bucket crowd pilot changeover valve 54 selects whether to guide the pilot pressure output from the bucket crowd pilot control valve 49 to the bucket directional control valve 42 or to the solenoid proportional valve unit 29. A bucket dump pilot changeover valve 55 selects whether to guide the pilot pressure output from the bucket dump pilot control valve 50 to the bucket directional control valve 42 or to the solenoid proportional valve unit 29.

The changeover valves 51 to 55 are each a solenoid-driven on/off valve driven by an output from the controller 25. When no output is received from the controller 25, the changeover valves 51 to 55 are held at a bypass position (depicted in FIG. 5), so that the pilot pressure supplied from the operation lever device 24 is guided to the directional control valve unit 30 not by way of the solenoid proportional valve unit 29. When an input is received from the controller 25, the changeover valves 51 to 55 are placed in a communication position, so that the pilot pressure supplied from the operation lever device 24 is guided to the directional control valve unit 30 by way of the solenoid proportional valve unit 29.

Figure 6:
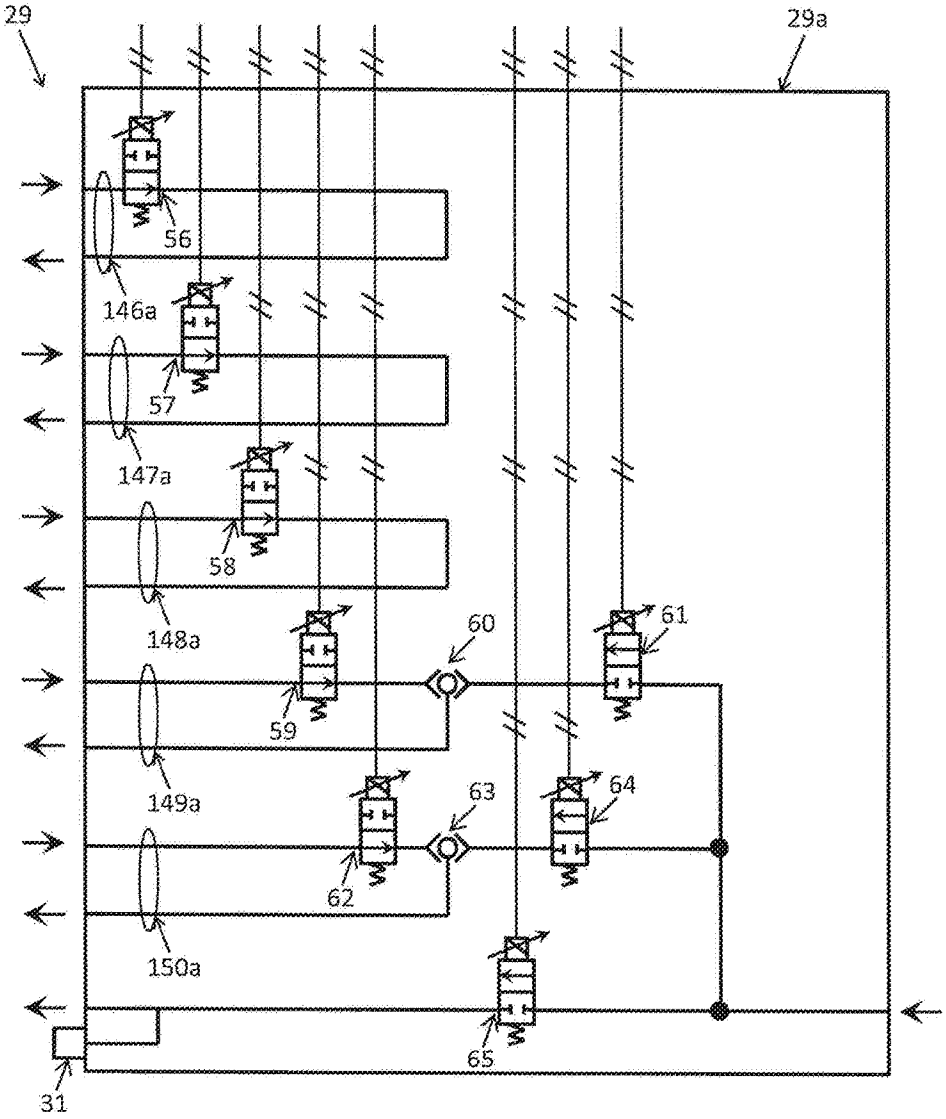
FIG. 6 is a hydraulic circuit diagram of a solenoid proportional valve unit.

FIG. 6 is a hydraulic circuit diagram of the solenoid proportional valve unit 29. As depicted in FIG. 6, the solenoid proportional valve unit 29 includes a boom lower pilot pressure reducing valve 56, an arm pull pilot pressure reducing valve 57, an arm push pilot pressure reducing valve 58, a bucket crowd pilot pressure reducing valve 59, a bucket crowd pilot shuttle valve 60, a bucket crowd pilot pressure boosting valve 61, a bucket dump pilot pressure reducing valve 62, a bucket dump pilot shuttle valve 63, a bucket dump pilot pressure boosting valve 64, a boom raise pilot pressure boosting valve 65, and a housing 29*a*, which houses the foregoing valves 56 to 65. The pilot pressure reducing valves 56 to 59 and 62 are each a solenoid proportional valve that can be placed in a fully open position at which the pilot pressure is not reduced and a fully closed position at which the pilot pressure is interrupted. The pilot pressure reducing valves 56 to 59 and 62 are each held in the fully open position when no command is received from the controller 25. The pilot pressure boosting valves 61, 64, and 65 are each a solenoid proportional valve that can be placed in a fully closed position at which the primary pilot pressure is interrupted and a fully open position at which the pilot pressure is not reduced. The pilot pressure boosting valves 61, 64, and 65 are each held in the fully open position when no command is received from the controller 25.

The boom lower pilot pressure reducing valve 56 reduces the boom lower pilot pressure supplied from the changeover valve unit 28 in response to a command from the controller 25. The arm pull pilot pressure reducing valve 57 reduces the arm pull pilot pressure supplied from the changeover valve unit 28 in response to a command from the controller 25. The arm push pilot pressure reducing valve 58 reduces the arm push pilot pressure supplied from the changeover valve unit 28 in response to a command from the controller 25.

The bucket crowd pilot pressure reducing valve 59 reduces the bucket crowd pilot pressure supplied from the changeover valve unit 28 in response to a command from the controller 25. The bucket crowd pilot pressure boosting valve 61 reduces the primary pilot pressure in response to a command from the controller 25 to thereby generate a bucket crowd pilot pressure. The bucket crowd pilot shuttle valve 60 outputs the pilot pressure output from the bucket crowd pilot pressure reducing valve 59 or the bucket crowd pilot pressure boosting valve 61, whichever is greater.

The bucket dump pilot pressure reducing valve 62 reduces the bucket dump pilot pressure supplied from the changeover valve unit 28 in response to a command from the controller 25. The bucket dump pilot pressure boosting valve 64 reduces the primary pilot pressure in response to a command from the controller 25 to thereby generate a bucket dump pilot pressure. The bucket dump pilot shuttle valve 63 outputs the pilot pressure output from the bucket dump pilot pressure reducing valve 62 or the bucket dump pilot pressure boosting valve 64, whichever is greater.

The boom raise pilot pressure boosting valve 65 reduces the primary pilot pressure in response to a command from the controller 25 to thereby generate a boom raise pilot pressure.

The pilot pressures generated by the solenoid proportional valves 56 to 59, 61, 62, and 64 are guided to the directional control valves 40 to 42 via the changeover valve unit 28. The pilot pressure (boom raise pilot pressure) generated by the solenoid proportional valve (boom raise pilot pressure boosting valve) 65 is guided to the boom raise operation shuttle valve 38.

The first temperature sensor 31, when being capable of detecting temperatures of the hydraulic fluid flowing through portions other than lines 146*a*, 146*b*, 147*a*, 147*b*, 148*a*, 148*b*, 149*a*, 149*b*, 150*a*, and 150*b* between the changeover valves 51 to 55 and the solenoid proportional valves 56 to 59, and 62, may be disposed at any position. The second temperature sensor 32 (depicted in FIGS. 2 and 4), when being capable of detecting temperatures of the hydraulic fluid flowing through the lines 146*a*, 146*b*, 147*a*, 147*b*, 148*a*, 148*b*, 149*a*, 149*b*, 150*a*, and 150*b* (depicted in FIGS. 5 and 6) between the changeover valves 51 to 55 and the solenoid proportional valves 56 to 59, and 62, may be disposed at any position.

Figure 7:
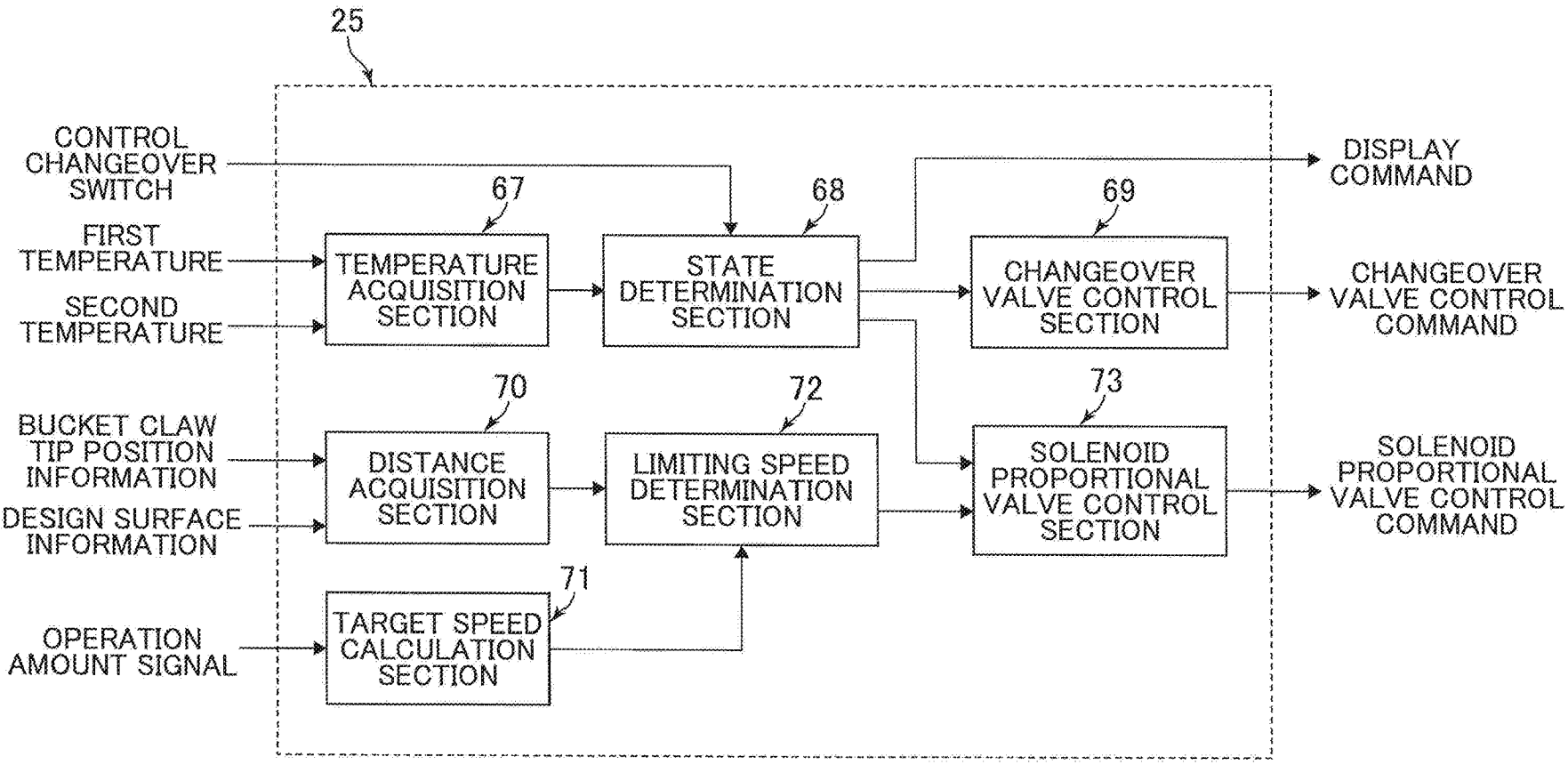
FIG. 7 is a functional block diagram of a controller.

FIG. 7 is a functional block diagram of the controller 25. As depicted in FIG. 7, the controller 25 includes a temperature acquisition section 67, a state determination section 68, a changeover valve control section 69, a distance acquisition section 70, a target speed calculation section 71, a limiting speed determination section 72, and a solenoid proportional valve control section 73.

The temperature acquisition section 67 acquires a first fluid temperature T1 detected by the first temperature sensor 31 and a second fluid temperature T2 detected by the second temperature sensor 32. The state determination section 68 changes outputs to the display device 26, the changeover valve control section 69, and the solenoid proportional valve control section 73 depending on the first fluid temperature T1 and the second fluid temperature T2 acquired by the temperature acquisition section 67 and the position of the control changeover switch 66. The changeover valve control section 69 controls the changeover valves 51 to 55 depending on an output from the state determination section 68. The distance acquisition section 70 acquires a distance between the bucket claw tip position P4 and a design surface that serves as a predetermined area. The target speed calculation section 71 calculates target speeds of the hydraulic actuators 11 to 13 and 23 on the basis of the pilot pressure (lever operation amount) detected by the pilot pressure sensor 27. The limiting speed determination section 72 determines limiting speeds of the hydraulic actuators 11 to 13 on the basis of the distance calculated by the distance acquisition section 70 and the target speeds calculated by the target speed calculation section 71. The solenoid proportional valve control section 73 controls the solenoid proportional valves 56 to 59, 61, 62, 64, and 65 so as to correspond to information enabling or disabling the area limiting control output from the state determination section 68 and the limiting speeds of the actuators output from the limiting speed determination section 72.

Figure 8:
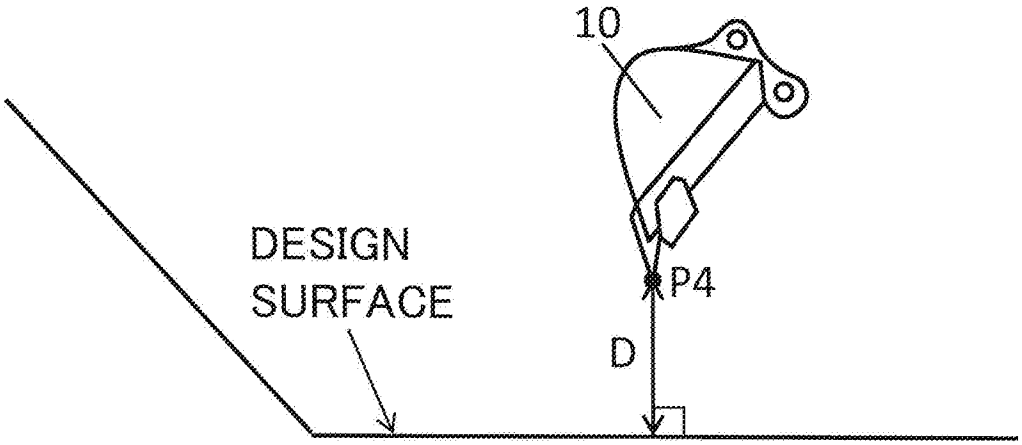
FIG. 8 is a schematic diagram depicting a distance between a bucket claw tip position and a design surface.

FIG. 8 is a schematic diagram depicting a distance D between the bucket claw tip position P4 and the design surface. The bucket claw tip position P4 is calculated using angle information obtained from the vehicle body inclination sensor 17, the boom inclination sensor 18, the arm inclination sensor 19, and the bucket inclination sensor 20 mounted in the hydraulic excavator 1, and orientation information and position information obtained from the first GNSS antenna 21 and the second GNSS antenna 22. The angle information and the position information obtained here represent the vehicle body inclination angle θ4, the boom 8-to-ground angle, the arm 9-to-ground angle, and the bucket 10-to-ground angle in the global coordinate system, and the coordinate of the vehicle body reference position P0 in the global coordinate system. The boom angle θ1 can be obtained by subtracting the vehicle body inclination angle θ4 from the boom-to-ground angle. The arm angle θ2 can be obtained by subtracting the boom-to-ground angle from the arm-to-ground angle. The bucket angle θ3 can be obtained by subtracting the arm-to-ground angle from the bucket-to-ground angle. The coordinate of the bucket claw tip position P4 may be found by a trigonometric function using the coordinate of the boom pin position P1 relative to the vehicle body reference position P0, the vehicle body inclination angle θ4, the boom length L1, the arm length L2, the bucket length L3, the boom angle θ1, the arm angle θ2, and the bucket angle θ3 (depicted in FIG. 2).

Figure 9:
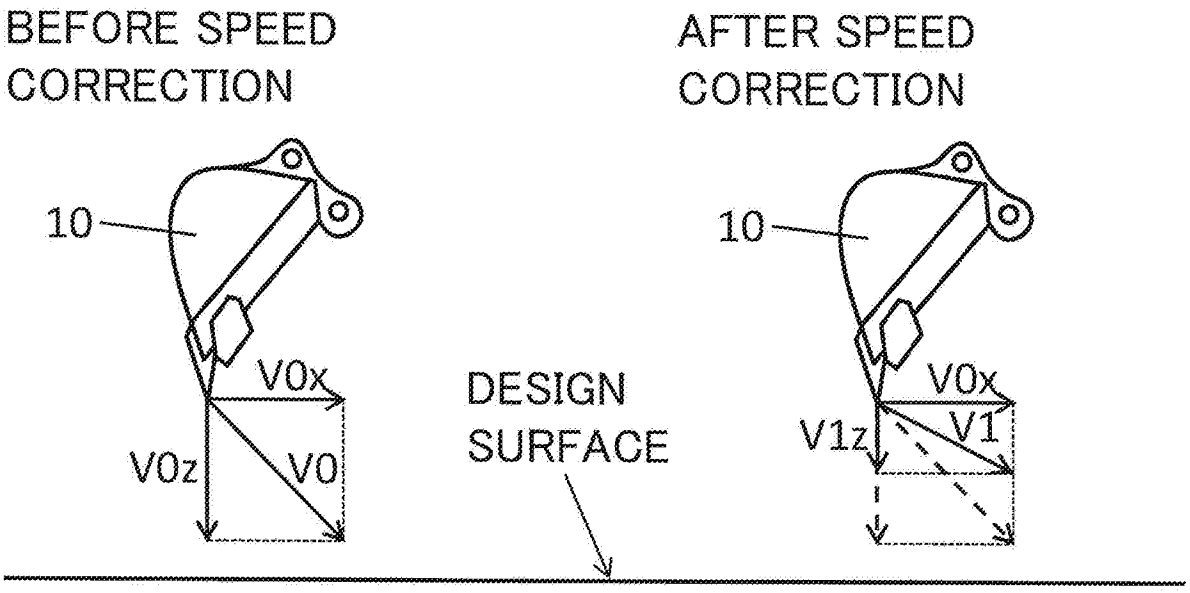
FIG. 9 is a schematic diagram depicting speed vectors before and after correction at the bucket claw tip position.

FIG. 9 is a schematic diagram depicting speed vectors before and after correction at the bucket claw tip position P4. The limiting speed determination section 72 calculates a speed vector V0 at the bucket claw tip position P4 on the basis of the arm cylinder target speed, the boom cylinder target speed, and the bucket cylinder target speed output from the target speed calculation section 71. The limiting speed determination section 72 then calculates V0*z* as a component in a design surface vertical direction of the speed vector V0 at the bucket claw tip position P4 and V0*x* as a component in a design surface horizontal direction of the speed vector V0 at the bucket claw tip position P4. The limiting speed determination section 72 next calculates a combined speed vector V1. The combined speed vector V1 represents a limiting speed V1*z*, which can be obtained by multiplying V0*z* by a speed correction factor k determined on the basis of the distance D between the bucket claw tip position P4 and the design surface, combined with V0*x* as the component in the design surface horizontal direction. The limiting speed determination section 72 then calculates the arm cylinder limiting speed, the boom cylinder limiting speed, and the bucket cylinder limiting speed that correspond to the speed vector V1 and outputs the limiting speeds to the solenoid proportional valve control section 73.

Figure 10:
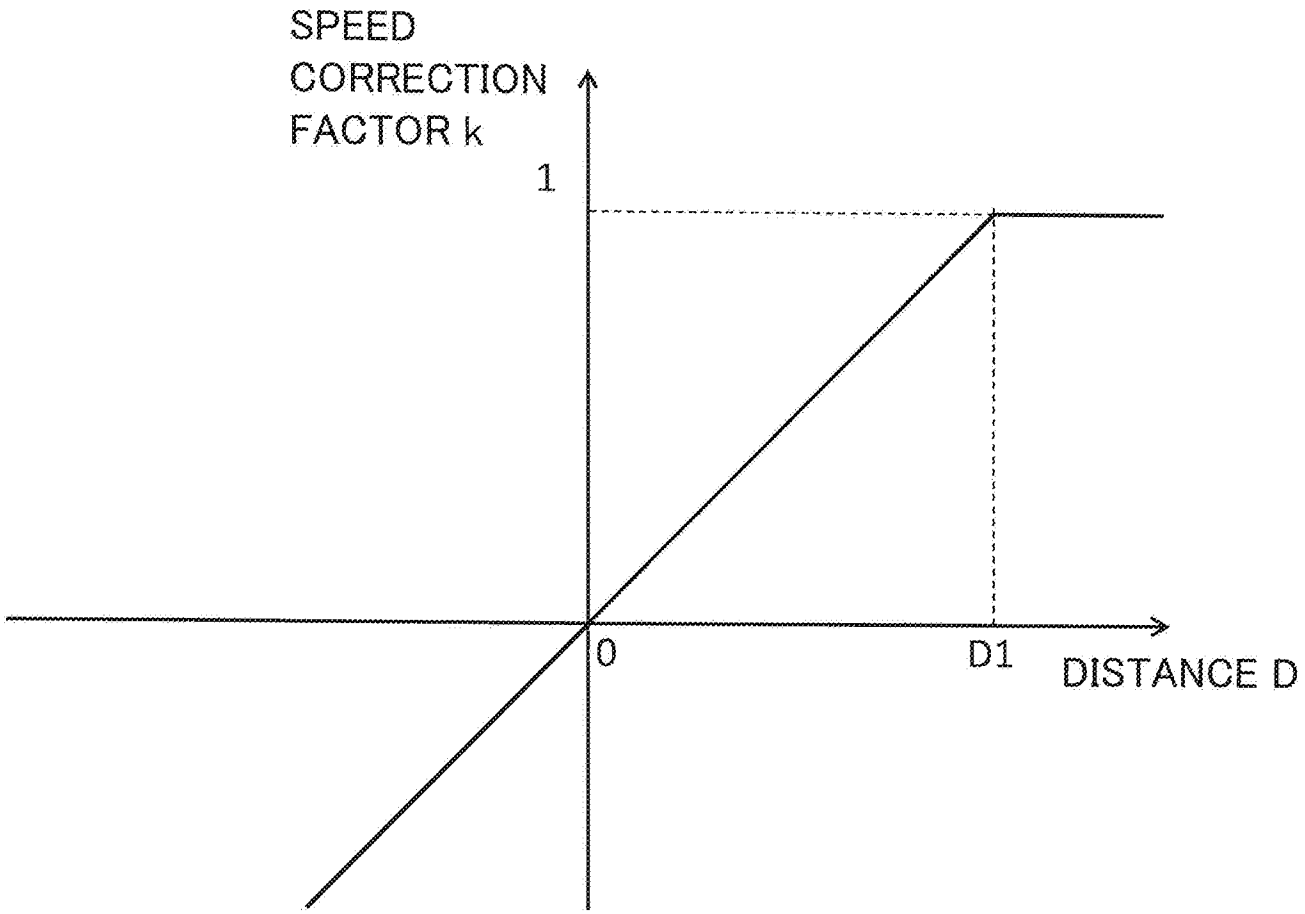
FIG. 10 is a graph depicting a relation between a distance between the bucket claw tip position and the design surface, and a speed correction factor.

FIG. 10 is a graph depicting a relation between the distance D between the bucket claw tip position P4 and the design surface, and the speed correction factor k. Assume that the distance is positive when the bucket claw tip position P4 is outward the design surface. Then, the speed correction factor k decreases at smaller values of the distance D during ordinary work, and the speed correction factor is 0 when the distance D is 0. It is noted that the speed vector is positive in the direction in which the speed vector approaches the design surface from outward of the design surface. Establishing the speed correction factor k as described above causes the speed vector in the direction in which the bucket claw tip position P4 advances into the design surface to decrease at distances from the bucket claw tip position P4 closer to the design surface, so that entry of the bucket 10 in the design surface can be prevented.

Figure 11:
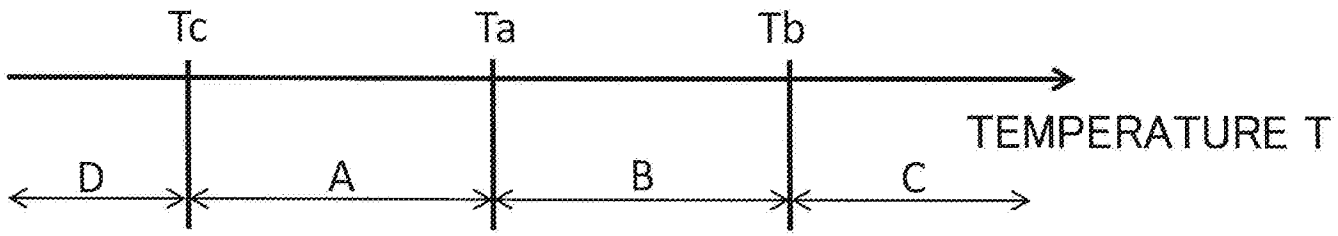
FIG. 11 is a diagram depicting divisions of temperature ranges of hydraulic fluid.

FIG. 11 is a diagram depicting divisions of temperature ranges of the hydraulic fluid. The state determination section 68 depicted in FIG. 7 determines a specific temperature range in which the first fluid temperature T1 and the second fluid temperature T2, which are acquired by the temperature acquisition section 67, fall. The temperature ranges are divided into a temperature range A, a temperature range B, a temperature range C, and a temperature range D. In the temperature range A, response of the work implement 7 is so reduced that accuracy in the area limiting control cannot be achieved. In the temperature range B, response of the work implement 7 can be obtained to the extent that accuracy in the area limiting control with respect to a mild lever operation can be achieved. In the temperature range C, response of the work implement 7 can be obtained to the extent that accuracy in the area limiting control with respect to an ordinary lever operation can be achieved. The temperature range D involves ultralow temperatures that can cause the solenoid proportional valves 56 to 59, 61, 62, 64, and 65 to malfunction. A lower limit temperature of the temperature range C (upper limit temperature of the temperature range B) Tb is set, for example, at a lower limit temperature of a fluid temperature range during ordinary operation of the hydraulic excavator 1 (e.g., 20° C.). A lower limit temperature Tc of the temperature range A (upper limit temperature of the temperature range D) is set, for example, at a lower limit temperature of an operable temperature range of the solenoid proportional valves 56 to 59, 61, 62, 64, and 65 (e.g., −10° C.). A lower limit temperature Ta of the temperature range B (upper limit temperature of the temperature range A) is set, for example, at a temperature between Tb and Tc (e.g., 0° C.). In the following, the temperature Ta is referred to as a first predetermined temperature, the temperature Tb is referred to as a second predetermined temperature, and the temperature Tc is referred to a second predetermined temperature.

FIG. 12 is a diagram depicting correspondence between the first fluid temperature T1, the second fluid temperature T2, and the position of the control changeover switch 66, and a command output from the state determination section 68 depicted in FIG. 7 to the changeover valve control section 69, the solenoid proportional valve control section 73, and the display device 26.

When the second fluid temperature T2 is equal to or lower than the third predetermined temperature Tc (falling in the temperature range D), the state determination section 68 outputs to the changeover valve control section 69 a command of turning off the changeover valve, outputs to the solenoid proportional valve control section 73 a command of disabling the control, and outputs to the display device 26 a command of warm-up instruction A display, regardless of the state of the control changeover switch 66.

When the second fluid temperature T2 is higher than the third predetermined temperature Tc (falling in any temperature range other than the temperature range D) and the first fluid temperature T1 is equal to or lower than the first predetermined temperature Ta (falling in the temperature range A), the state determination section 68 outputs to the changeover valve control section 69 a command of turning on the changeover valve, outputs to the solenoid proportional valve control section 73 a command of disabling the control, and outputs to the display device 26 a command of warm-up instruction A display, regardless of the state of the control changeover switch 66.

When the second fluid temperature T2 is higher than the third predetermined temperature Tc (falling in any temperature range other than the temperature range D) and the first fluid temperature T1 is higher than the first predetermined temperature Ta and equal to or lower than the second predetermined temperature Tb (falling in the temperature range B), the state determination section 68 outputs to the changeover valve control section 69 a command of turning on the changeover valve, outputs to the solenoid proportional valve control section 73 a command of enabling the control, and outputs to the display device 26 a command of warm-up instruction B display, when the control changeover switch 66 is on. Under the same temperature conditions and when the control changeover switch 66 is off, the state determination section 68 outputs to the changeover valve control section 69 a command of turning off the changeover valve, outputs to the solenoid proportional valve control section 73 a command of disabling the control, and outputs to the display device 26 a command of warm-up instruction non-display.

When the second fluid temperature T2 is higher than the third predetermined temperature Tc (falling in any temperature range other than the temperature range D) and the first fluid temperature T1 is higher than the second predetermined temperature Tb (falling in the temperature range C) and when the control changeover switch 66 is on, the state determination section 68 outputs to the changeover valve control section 69 a command of turning on the changeover valve, outputs to the solenoid proportional valve control section 73 a command of enabling the control, and outputs to the display device 26 a command of warm-up instruction non-display. Under the same temperature conditions and when the control changeover switch 66 is off, the state determination section 68 outputs to the changeover valve control section 69 a command of turning off the changeover valve, outputs to the solenoid proportional valve control section 73 a command of disabling the control, and outputs to the display device 26 a command of warm-up instruction non-display.

Reference is made back to FIG. 7. When a command of turning on the changeover valve is received from the state determination section 68, the changeover valve control section 69 drives the changeover valves 51 to 55 to bring the changeover valves 51 to 55 into the communication position, so that the pilot pressure output from the operation lever device 24 is guided to the solenoid proportional valve unit 29. When a command of turning off the changeover valve is received from the state determination section 68, the changeover valve control section 69 does not drive the changeover valves 51 to 55 and holds the changeover valves 51 to 55 in the bypass position, so that the pilot pressure output from the operation lever device 24 is guided to the directional control valve unit 30 not by way of the solenoid proportional valve unit 29.

When a command of enabling the control is received from the state determination section 68, the solenoid proportional valve control section 73 drives the solenoid proportional valves 56 to 59, 61, 62, 64, and 65 on the basis of the limiting speeds of the actuators determined by the limiting speed determination section 72. When a command of disabling the control is received from the state determination section 68, the solenoid proportional valve control section 73 does not drive the solenoid proportional valves 56 to 59, 61, 62, 64, and, 65 and the pilot pressure supplied from the changeover valve unit 28 is returned to the changeover valve unit 28 without being corrected.

Figure 13:
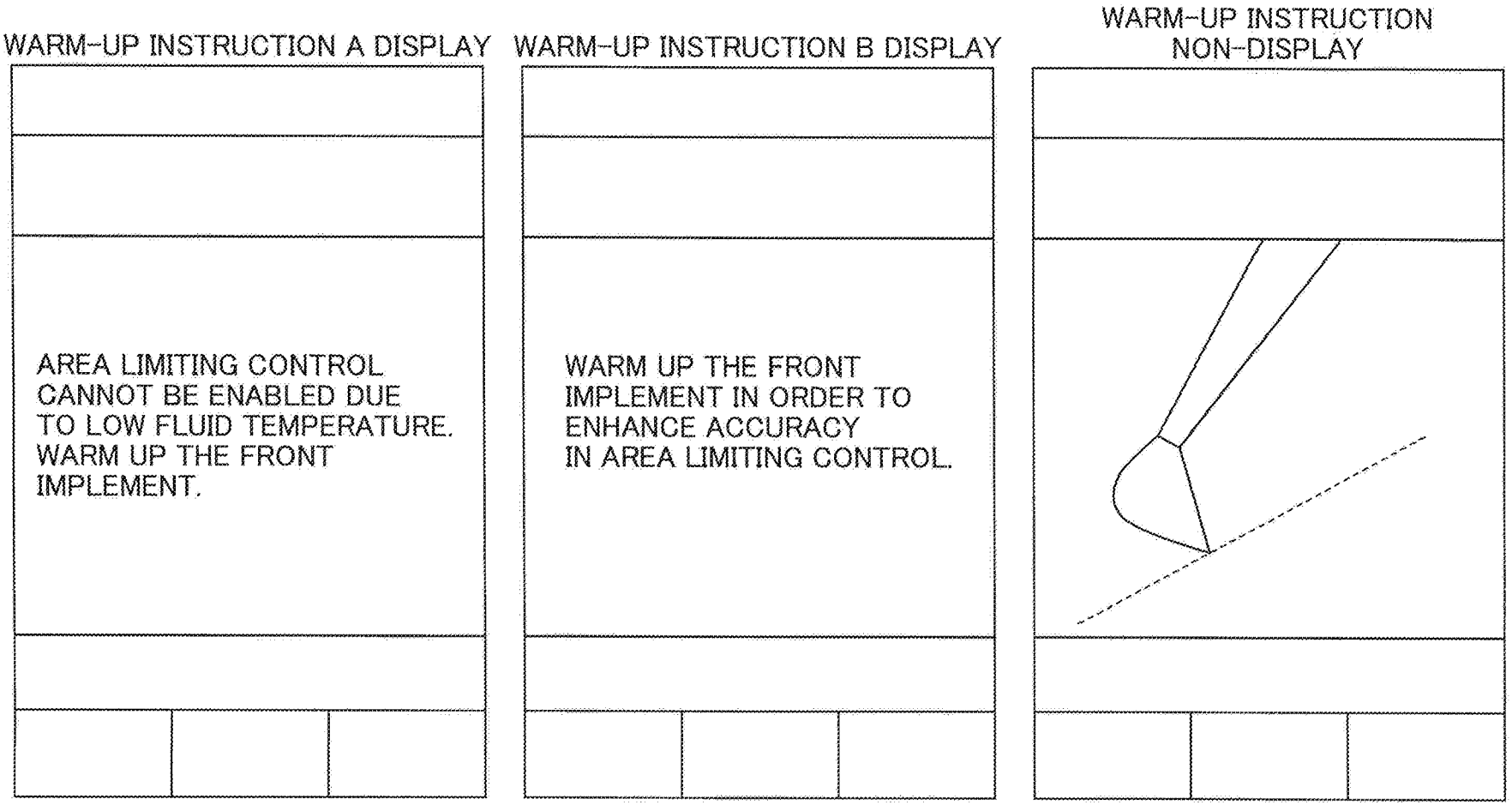
FIG. 13 illustrates examples of screens to be displayed on the display device.

FIG. 13 illustrates examples of screens to be displayed on the display device 26 depicted in FIG. 3. The reception of a command of warm-up instruction A display by the display device 26 from the state determination section 68 depicted in FIG. 7 indicates that the area limiting control cannot be enabled in the current operation state. The display device 26 thus displays a message indicating that the area limiting control cannot be enabled and a message prompting a warm-up operation of the front (work implement 7 depicted in FIG. 1). The reception of a command of warm-up instruction B display by the display device 26 from the state determination section 68 indicates that accuracy in the area limiting control cannot be achieved in the current operation state. The display device 26 thus displays a message prompting a warm-up operation of the front in order to enhance accuracy in the area limiting control. When a command of warm-up instruction non-display is received, the display device 26 does not display the message prompting a warm-up operation of the front, but displays information on the standard instruments of the hydraulic excavator 1 and on the distance between the work implement 7 and the design surface.

In accordance with the hydraulic excavator 1 according to the present embodiment configured as described above, when the first fluid temperature T1 is higher than the first predetermined temperature Ta and the control changeover switch 66 specifies enabling of the area limiting control, the changeover valves 51 to 55 are brought into the communication position and the solenoid proportional valves 56 to 59, 61, 62, 64, and 65 are operated according to the area limiting control. Thereby, the area limiting control can be performed while response of the work implement 7 is achieved.

When the first fluid temperature T1 is higher than the first predetermined temperature Ta and the control changeover switch 66 specifies disabling of the area limiting control, the changeover valves 51 to 55 are brought into the bypass position, so that the hydraulic fluid does not flow through, out of the pilot lines 143 to 150, the lines 146*a*, 146*b*, 147*a*, 147*b*, 148*a*, 148*b*, 149*a*, 149*b*, 150*a*, and 150*b*, which connect between the changeover valves 51 to 55 and the solenoid proportional valves 56 to 59 and 62. Response of the work implement 7 can thereby be improved.

When the first fluid temperature T1 is equal to or lower than the first predetermined temperature Ta, the changeover valves 51 to 55 are brought into the communication position and the solenoid proportional valves 56 to 59 and 62 are placed in the fully open position to thereby allow the hydraulic fluid to flow through, out of the pilot lines 143 to 150, the lines 146*a*, 146*b*, 147*a*, 147*b*, 148*a*, 148*b*, 149*a*, 149*b*, 150*a*, and 150*b*, which connect between the changeover valves 51 to 55 and the solenoid proportional valves 56 to 59 and 62. The fluid temperature at the lines can thereby be maintained at a temperature higher than the first predetermined temperature Ta (at which the response of the work implement 7 can be achieved) even while the area limiting control is disabled.

When the second fluid temperature T2 is equal to or lower than the third predetermined temperature (falling in the temperature range D), the display device 26 displays the warm-up instruction A. The operator can thereby be notified that the area limiting control cannot be enabled and can be prompted to perform a warm-up operation of the work implement 7.

When the second fluid temperature T2 is higher than the third predetermined temperature Tc (falling in any temperature range other than the temperature range D) and the first fluid temperature T1 is higher than the first predetermined temperature Ta and equal to or lower than the second predetermined temperature Tb (falling in the temperature range B), the display device 26 displays the warm-up instruction B when the control changeover switch 66 is placed in the on position. The operator can thereby be notified that the area limiting control cannot be sufficiently performed and can be prompted to perform a warm-up operation of the work implement 7.

When the second fluid temperature T2 is equal to or lower than the lower limit temperature Tc of the operable temperature range of the solenoid proportional valves 56 to 59, 61, 62, 64, and 65 (falling in the temperature range D), the changeover valves 51 to 55 are brought into the bypass position to thereby prevent the hydraulic fluid at ultralow temperatures from flowing through the solenoid proportional valves 56 to 59, 62, and 65, so that the solenoid proportional valves 56 to 59, 62, and 65 can be prevented from malfunctioning.

While the present invention has been described in detail with reference to the specific application thereof, it should be noted that the present invention is not limited to the above-described embodiment and may include various modifications. For example, although the above-described embodiment has exemplified a configuration of the hydraulic excavator including the bucket as the work implement, the present invention may still be applicable to hydraulic excavator including any work implement other than the bucket and any other type of work machines than the hydraulic excavator. The entire detailed configuration of the embodiment, which has been described for ease of understanding of the present invention, is not always necessary to embody the present invention.

DESCRIPTION OF REFERENCE CHARACTERS

1: Hydraulic excavator
2: Track structure
3: Swing structure
4: Cab
5: Machine chamber
6: Counterweight
7: Work implement
8: Boom
9: Arm
10: Bucket
11: Boom cylinder (hydraulic actuator)
12: Arm cylinder (hydraulic actuator)
13: Bucket cylinder (hydraulic actuator)
14: Hydraulic pump
15: Pilot pump
16: Engine (prime mover)

17: Vehicle body inclination sensor
18: Boom inclination sensor
19: Arm inclination sensor
20: Bucket inclination sensor
21: First GNSS antenna
22: Second GNSS antenna
23: Swing motor (hydraulic actuator)
24: Operation lever device
25: Controller
26: Display device
27: Pilot pressure sensor
28: Changeover valve unit
28*a*: Housing
29: Solenoid proportional valve unit
29*a*: Housing
30: Directional control valve unit
31: First temperature sensor (first temperature detection device)
32: Second temperature sensor (second temperature detection device)
33: Pilot shutoff valve
34: Swing operation lever
35: Boom operation lever
36: Arm operation lever
37: Bucket operation lever
38: Boom raise operation shuttle valve
39: Swing directional control valve
40: Boom directional control valve
41: Arm directional control valve
42: Bucket directional control valve
43: Clockwise swing pilot control valve
44: Counterclockwise swing pilot control valve
45: Boom raise pilot control valve
46: Boom lower pilot control valve
47: Arm pull pilot control valve
48: Arm push pilot control valve
49: Bucket crowd pilot control valve
50: Bucket dump pilot control valve
51: Boom lower pilot control valve
52: Arm pull pilot changeover valve
53: Arm push pilot changeover valve
54: Bucket crowd pilot changeover valve
55: Bucket dump pilot changeover valve
56: Boom lower pilot pressure reducing valve
57: Arm pull pilot pressure reducing valve
58: Arm push pilot pressure reducing valve
59: Bucket crowd pilot pressure reducing valve
60: Bucket crowd pilot shuttle valve
61: Bucket crowd pilot pressure boosting valve
62: Bucket dump pilot pressure reducing valve
63: Bucket dump pilot shuttle valve
64: Bucket dump pilot pressure boosting valve
65: Boom raise pilot pressure boosting valve
66: Control changeover switch
67: Temperature acquisition section
68: State determination section
69: Changeover valve control section
70: Distance acquisition section
71: Target speed calculation section
72: Limiting speed determination section
73: Solenoid proportional valve control section
100: Hydraulic control system
143: Clockwise swing pilot line
144: Counterclockwise swing pilot line
145: Boom raise pilot line
146: Boom lower pilot line
146*a*, 146*b*: Line
147: Arm pull pilot line
147*a*, 147*b*: Line
148: Arm push pilot line
148*a*, 148*b*: Line
149: Bucket crowd pilot line
149*a*, 149*b*: Line
150: Bucket dump pilot line
150*a*, 150*b*: Line

The invention claimed is:

1. A work machine including:

a prime mover;

a hydraulic pump driven by the prime mover;

a pilot pump driven by the prime mover;

a plurality of hydraulic actuators driven by hydraulic fluid supplied from the hydraulic pump;

a work implement driven by the hydraulic actuators;

a plurality of directional control valves that control the hydraulic fluid supplied from the hydraulic pump to the hydraulic actuators;

a plurality of hydraulic pilot type operation devices that reduce pressure of the hydraulic fluid supplied from the pilot pump to thereby generate a plurality of pilot pressures for operating the directional control valves;

a plurality of solenoid proportional valves disposed in a plurality of pilot lines through which the pilot pressures are guided to the directional control valves, the solenoid proportional valves being operable between a fully open position at which the pilot pressures are not reduced and a fully closed position at which the pilot pressures are interrupted;

a controller that performs area limiting control for correcting the pilot pressures by operating the solenoid proportional valves so as not to allow the work implement to enter a predetermined area;

a control changeover switch that specifies enabling or disabling of the area limiting control; and a plurality of changeover valves disposed in the pilot lines, the changeover valves being capable of being brought into a communication position at which communication is provided through the pilot lines or a bypass position at which the solenoid proportional valves are bypassed, the work machine comprising:

a first fluid temperature detection device that detects as a first fluid temperature a temperature of the hydraulic fluid flowing through, out of the pilot lines, lines between the changeover valves and the solenoid proportional valves, wherein the controller includes:

a state determination section that determines whether the first fluid temperature is higher than a first predetermined temperature and determines which, whether enabling or disabling, the control changeover switch specifies for the area limiting control;

a changeover valve control section that brings the changeover valves into the communication position when the state determination section determines that the first fluid temperature is higher than the first predetermined temperature and determines that the control changeover switch specifies enabling for the area limiting control, that brings the changeover valves into the bypass position when the state determination section determines that the first fluid temperature is higher than the first predetermined temperature and determines that the control changeover switch specifies disabling for the area limiting control, and that brings the changeover valves into the communication position when the state determination section determines that the first fluid temperature is equal to or lower than the first predetermined temperature; and a solenoid proportional valve control section that operates the solenoid proportional valves in accordance with the area limiting control when the state determination section determines that the first fluid temperature is higher than the first predetermined temperature and determines that the control changeover switch specifies enabling of the area limiting control, and that brings the solenoid proportional valves into the fully open position when the state determination section determines that the first fluid temperature is equal to or lower than the first predetermined temperature.

2. The work machine according to claim 1, wherein the first predetermined temperature is set to be higher than a lower limit temperature of an operable temperature range of the solenoid proportional valves and lower than a lower limit temperature of a temperature range of the hydraulic fluid during an ordinary operation of the work machine.

3. The work machine according to claim 2, further comprising:

a display device, wherein the controller is configured to cause the display device to display a message that prompts a warm-up operation of the work machine when the first fluid temperature is equal to or lower than a second predetermined temperature set to be higher than the first predetermined temperature.

4. The work machine according to claim 3, wherein the second predetermined temperature is set at the lower limit temperature of the temperature range of the hydraulic fluid during an ordinary operation of the work machine.

5. The work machine according to claim 4, further comprising:

a second fluid temperature detection device that detects as a second fluid temperature a temperature of the hydraulic fluid flowing through any pilot line other than the lines, wherein the controller is configured to bring the changeover valves into the bypass position when the second fluid temperature is equal to or lower than a third predetermined temperature set to be lower than the first predetermined temperature.

6. The work machine according to claim 5, wherein the third predetermined temperature is set at the lower limit temperature of the operable temperature range of the solenoid proportional valves.

* * * * *